US011335527B2

(12) United States Patent
Morimura

(10) Patent No.: US 11,335,527 B2
(45) Date of Patent: May 17, 2022

(54) METHOD FOR CONTROLLING ELECTROMAGNETIC RELAY

(71) Applicant: FUJITSU COMPONENT LIMITED, Tokyo (JP)

(72) Inventor: Masato Morimura, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 16/897,503

(22) Filed: Jun. 10, 2020

(65) Prior Publication Data

US 2020/0303147 A1 Sep. 24, 2020

Related U.S. Application Data

(63) Continuation of application No. 15/939,805, filed on Mar. 29, 2018.

(30) Foreign Application Priority Data

Apr. 6, 2017 (JP) ..... JP2017-076141

(51) Int. Cl.
*H01H 51/22* (2006.01)
*H01H 50/18* (2006.01)
(Continued)

(52) U.S. Cl.
CPC ..... *H01H 51/2209* (2013.01); *H01H 50/02* (2013.01); *H01H 50/14* (2013.01);
(Continued)

(58) Field of Classification Search
CPC ..... H01H 51/2209; H01H 51/2227; H01H 50/56; H01H 50/44; H01H 50/36;
(Continued)

(56) References Cited

U.S. PATENT DOCUMENTS 2,941,122 A 6/1960 Fehling
3,097,328 A * 7/1963 Saner ..... H01H 50/38 335/274
(Continued)

FOREIGN PATENT DOCUMENTS

CN 108695112 10/2018
EP 0173353 3/1986
(Continued)

OTHER PUBLICATIONS

Office Action dated Oct. 16, 2020 issued with respect to the related U.S. Appl. No. 15/939,805.
(Continued)

*Primary Examiner* — Mohamad A Musleh
(74) *Attorney, Agent, or Firm* — IPUSA, PLLC

(57) ABSTRACT

A method is for controlling an electromagnetic relay comprising a fixed contact, a movable contact that comes in contact with and separated from the fixed contact, an electromagnet that includes a coil for generating magnetic field, and an actuator that moves the movable contact. The method includes: when separating the movable contact that is in contact with the fixed contact, supplying a first current to the coil to generate a first magnetomotive force that drives the actuator in a direction to move the movable contact toward the fixed contact, supplying a second current to the coil, while the first current is supplied to the coil, to generate a second magnetomotive force that drives the actuator in a direction to move the movable contact away from the fixed contact, and stop supplying the first current while the second current is supplied to the coil.

5 Claims, 16 Drawing Sheets

(51) Int. Cl.
*H01H 50/02* (2006.01)
*H01H 50/14* (2006.01)
*H01H 50/36* (2006.01)
*H01H 50/44* (2006.01)
*H01H 50/56* (2006.01)

(52) U.S. Cl.
CPC ..... *H01H 50/18* (2013.01); *H01H 50/36* (2013.01); *H01H 50/44* (2013.01); *H01H 50/56* (2013.01); *H01H 51/2227* (2013.01); *H01H 2051/2218* (2013.01)

(58) Field of Classification Search
CPC ..... H01H 50/18; H01H 50/14; H01H 50/02; H01H 2051/2218; H01H 50/16
See application file for complete search history.

(56) References Cited

U.S. PATENT DOCUMENTS 4,509,026 A * 4/1985 Matsushita ..... H01H 51/2209 335/132
4,587,501 A * 5/1986 Agatahama ..... H01H 51/2227 335/202
5,321,377 A * 6/1994 Aharonian ..... H01H 50/16 335/128
5,574,416 A * 11/1996 Maruyama ..... H01H 51/2227 335/78
6,320,485 B1 * 11/2001 Gruner ..... H01H 50/546 335/132
8,008,999 B2 8/2011 Morimura
8,659,372 B2 * 2/2014 Morimura ..... H01H 50/02 335/201
2010/0039195 A1 * 2/2010 Morimura ..... H01H 51/2227 335/189
2011/0115586 A1 * 5/2011 Morimura ..... H01H 9/36 335/185
2013/0307649 A1 11/2013 Morimura
2018/0294121 A1 10/2018 Morimura

FOREIGN PATENT DOCUMENTS

JP S55-102749 U 7/1980
JP S56-140133 U 10/1981
JP S61-061325 3/1986
JP 2010-044973 2/2010
JP 2013-218890 10/2013
JP 2014-235823 12/2014
KR 20160050425 5/2016
KR 10-1681966 12/2016

OTHER PUBLICATIONS

Office Action dated Aug. 10, 2021 with respect to the corresponding U.S. Appl. No. 15/939,805.

* cited by examiner

METHOD FOR CONTROLLING ELECTROMAGNETIC RELAY

CROSS-REFERENCE TO RELATED APPLICATION

The present application is a continuation application and claims the benefit of priority under 35 U.S.C 120 of U.S. patent application Ser. No. 15/939,805 filed on Mar. 29, 2018, which is based on and claims priority to Japanese Priority Application No. 2017-076141 filed on Apr. 6, 2017. The contents of the applications are incorporated herein by reference in their entirety.

BACKGROUND

1. Field of the Invention

The present invention relates to a method for controlling an electromagnetic relay.

2. Description of the Related Art

For flowing and shutting current in a target device that generates high-current, generally, an electromagnetic contactor that has a larger current capacity compared with an electromagnetic relay is used. Meanwhile, as disclosed in Patent Document 1, for example, an electromagnetic relay that can flow high-current and shut the current while making a device size small is suggested.

If an electromagnetic relay can be used for flowing and shutting the current in a target device that generates high-current, the device can be made small and light compared with a contactor. However, higher reliability is required for an electromagnetic relay such as one disclosed in Patent Document 1.

[Patent Document 1] Japanese Laid-open Patent Publication No. 2010-44973

SUMMARY OF THE INVENTION

According to an embodiment, a method is for controlling an electromagnetic relay comprising a fixed contact, a movable contact that comes in contact with and separated from the fixed contact, an electromagnet that includes a coil for generating magnetic field, and an actuator that moves the movable contact by the magnetic field generated by the electromagnet. The method includes: when separating the movable contact that is in contact with the fixed contact, supplying a first current to the coil to generate a first magnetomotive force that drives the actuator in a direction to move the movable contact toward the fixed contact, supplying a second current to the coil, while the first current is supplied to the coil, to generate a second magnetomotive force that drives the actuator in a direction to move the movable contact away from the fixed contact, and stop supplying the first current while the second current is supplied to the coil.

BRIEF DESCRIPTION OF THE DRAWINGS

Other objects, features and advantages of the present invention will become more apparent from the following detailed description when read in conjunction with the accompanying drawings.

DESCRIPTION OF THE EMBODIMENTS

Figure 1:
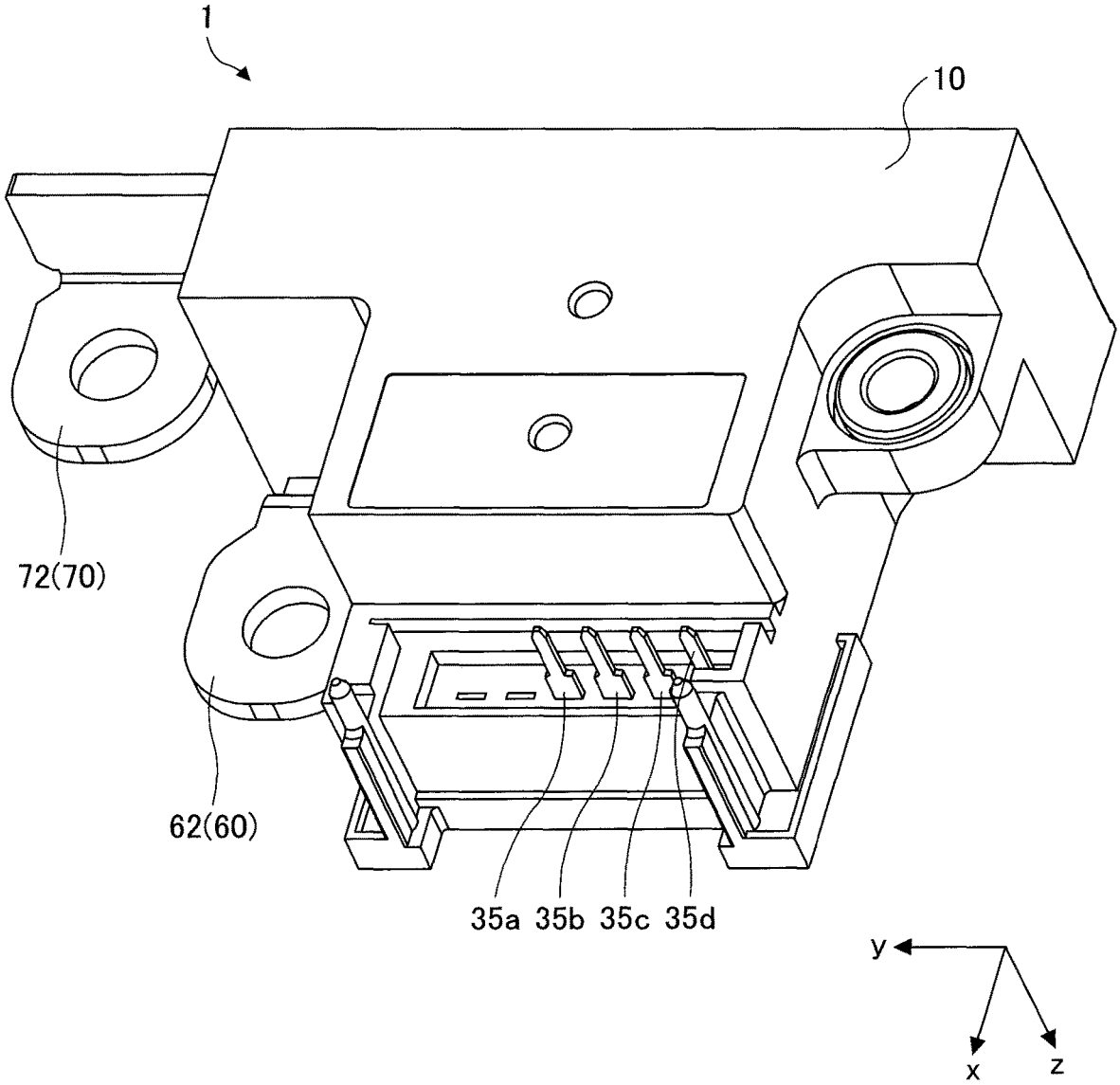
FIG. 1 is a perspective view of an electromagnetic relay of an embodiment.

The invention will be described herein with reference to illustrative embodiments. Those skilled in the art will recognize that many alternative embodiments can be accomplished using the teachings of the present invention and that the invention is not limited to the embodiments illustrated for explanatory purposes.

In the drawings, the same components are given the same reference numerals, and explanations are not repeated.

Figure 2:
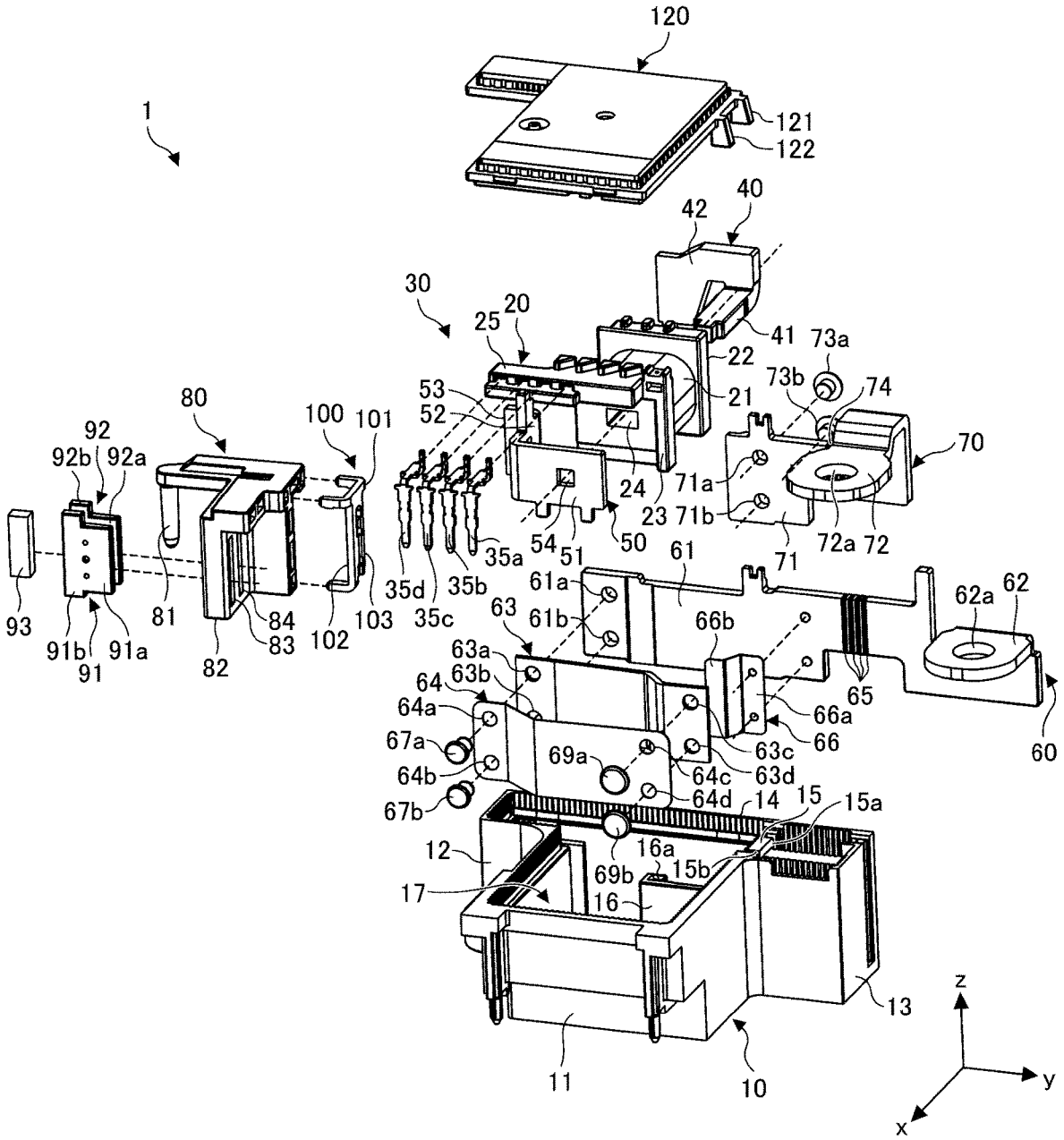
FIG. 2 is an exploded perspective view of the electromagnetic relay illustrated in FIG. 1.
Figure 3:
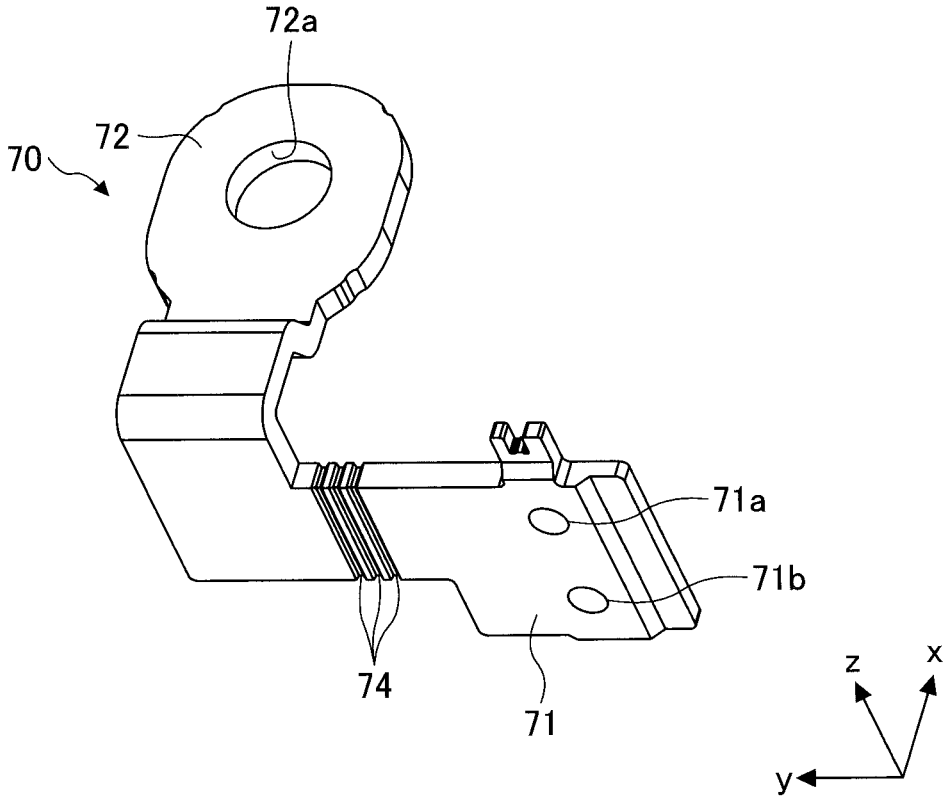
FIG. 3 is a perspective view of a fixed terminal seen from a back surface side of FIG. 2.
Figure 4:
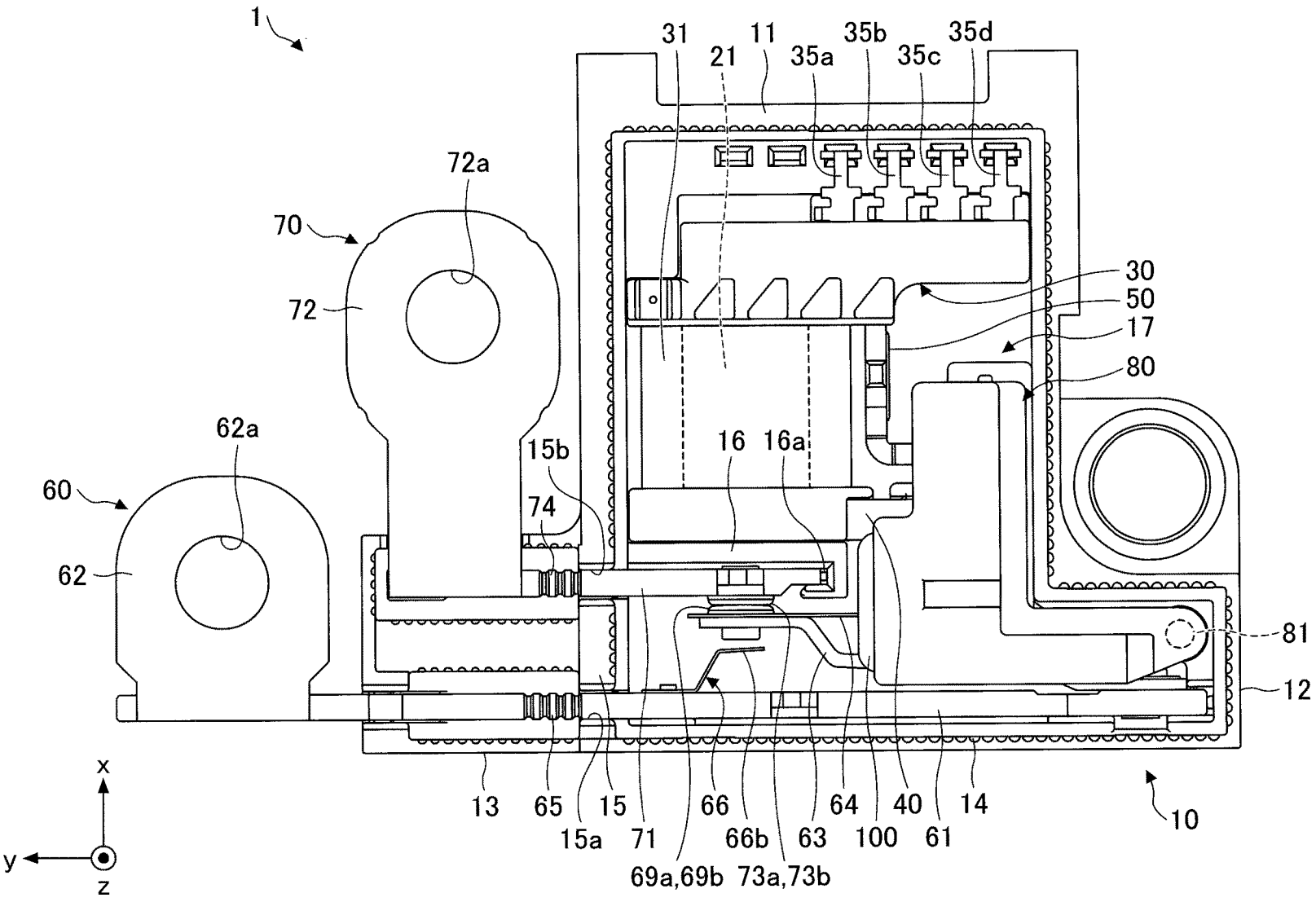
FIG. 4 is a view illustrating a closed state of the electromagnetic relay.
Figure 5:
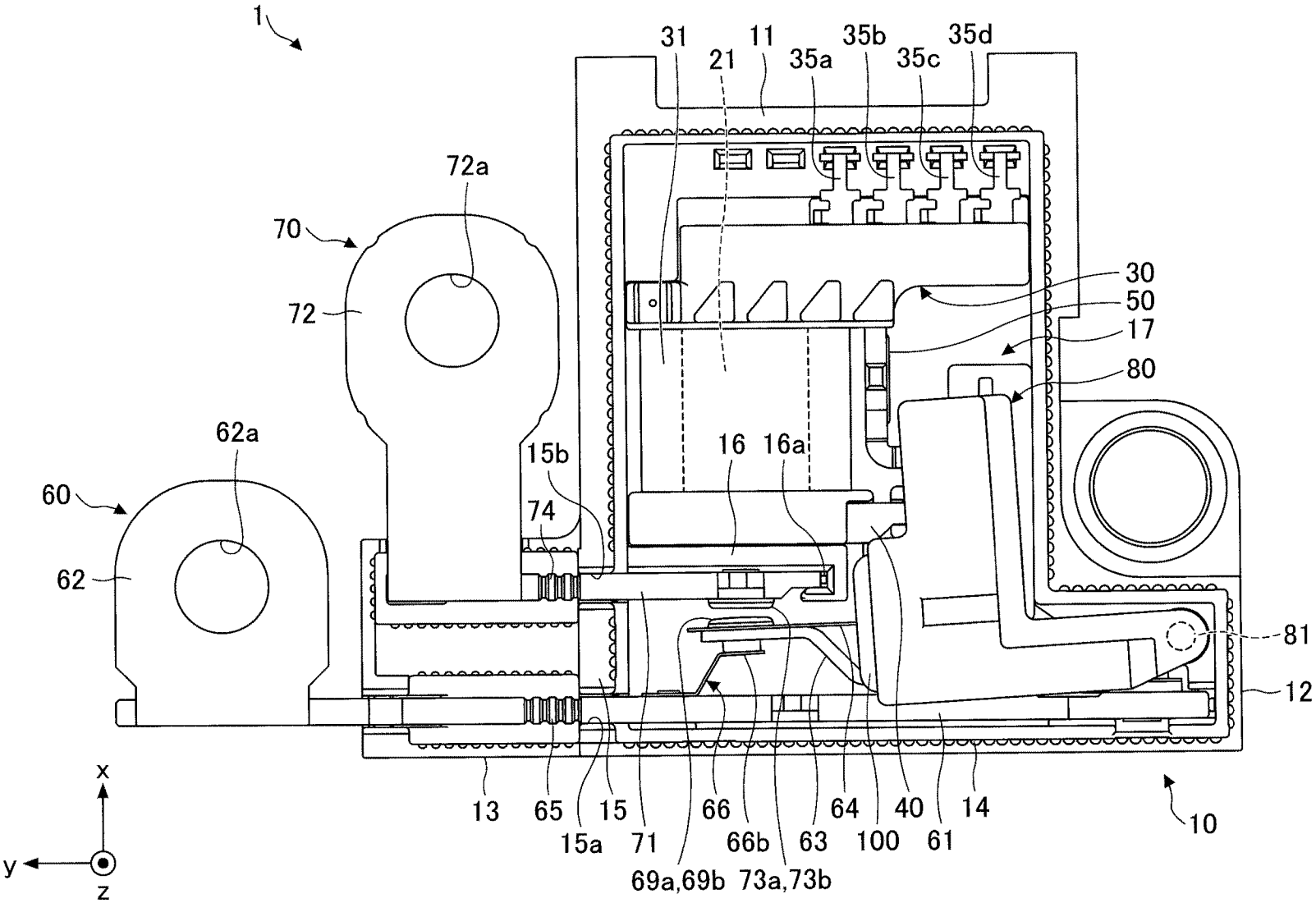
FIG. 5 is a view illustrating a opened state of the electromagnetic relay.

An electromagnetic relay ("relay") 1 of the embodiment is described with reference to FIG. 1 to FIG. 5. FIG. 1 is a perspective view of the relay 1. FIG. 2 is an exploded perspective view of the relay 1. FIG. 3 is a perspective view of a fixed terminal 70 seen from a back side of FIG. 2. FIG. 4 is a view illustrating a closed state of the relay 1. FIG. 5 is a view illustrating an opened state of the relay 1.

As illustrated in FIG. 4 and FIG. 5, the relay 1 includes a base 10, a movable terminal 60, a backstop 66, a braided wire 63, a movable spring 64, movable contacts 69*a* and 69*b*, fixed contacts 73*a* and 73*b*, the fixed terminal 70, an electromagnet 30, coil terminals 35*a*, 35*b*, 35*c* and 35*d*, an actuator 80 and a card 100. As illustrated in FIG. 2, the relay 1 further includes a cover 120, armatures 91 and 92 and a permanent magnet 93. The armatures 91 and 92 and the permanent magnet 93 function as a part of the actuator 80.

The relay 1 is a polar electromagnetic relay that uses the permanent magnet 93. The relay 1 electrically connects or disconnects the movable terminal 60 and the fixed terminal 70, which are bus bar terminals. The movable terminal 60 and the fixed terminal 70 are connected to a target device such as an on-vehicle engine starter. In such a case, the relay 1 functions to supply current to the target device by electrically connecting the movable terminal 60 and the fixed terminal 70, and shut the current to the target device in an emergency.

As illustrated in FIG. 1, inner components of the relay 1 are sealed by the base 10 and the cover 120, and connection portions 62 and 72 of the movable terminal 60 and the fixed terminal 70 that are connected to the target device, and coil terminals 35*a* to 35*d* for inputting a signal for controlling flowing and shutting operations are exposed.

Hereinafter, for describing the shapes and positional relationships of the components of the relay 1, three axes which are perpendicular to each other are used as a reference. As illustrated in FIG. 4, +x direction is a direction in which the movable contacts 69*a* and 69*b* are approaching the fixed contacts 73*a* and 73*b*, and −x direction is a direction in which the movable contacts 69*a* and 69*b* are separating from the fixed contacts 73*a* and 73*b*. +y direction is a direction of a side at which the connection portions 62 and 72 are provided, respectively, and −y direction is a direction toward the other side. As illustrated in FIG. 2, +z direction is a direction toward the cover 120 in a stacking direction of the cover 120 and the base 10, and −z direction is a direction toward the base 10 in the stacking direction. The z-axis may be a vertical direction, and the x-axis and the y-axis may be horizontal directions that are perpendicular to the z-axis, respectively.

As illustrated in FIG. 2, FIG. 4 and FIG. 5, the base 10 has a box-shape and is provided with an opening that is open toward +z direction. The base 10 is made of a resin mold. The base 10 includes a center portion 11 and extended portions 12 and 13 that are protruded in both sides in y-axis direction along an outer wall 14. The extended portion 12 is protruded in −y direction and the extended portion 13 is protruded in +y direction. An inner space of the extended portion 12 is communicating with the center portion 11. The center portion 11 and the extended portion 12 function as an accommodating portion 17 that accommodates the electromagnet 30, the actuator 80 and the like, which will be described later. Further, an inner space of the extended portion 13 is sectioned from the accommodating portion 17 by an inner wall 15.

As illustrated in FIG. 2, the movable terminal 60 includes the plate 61 that extends along an inner surface of the outer wall 14, and the connection portion 62. The connection portion 62 is formed at an end of the movable terminal 60 at +y side to be bent from the plate 61 and to horizontally extend in +x direction. The connection portion 62 may be formed into a shape preferable to be connected to a power supply line of the target device. An opening 62*a* is formed at the connection portion 62 so that the movable terminal 60 can be connected to the target device by a bolt.

A groove 65 is formed at the plate 61 over the entire perimeter around y-axis. Further, two holes 61*a* and 61*b* are formed at the plate 61 near an end at −y side that are aligned in Z direction.

Similarly to the movable terminal 60, as illustrated in FIG. 2 and FIG. 3, the fixed terminal 70 includes the plate 71 and the connection portion 72. The connection portion 72 is formed at an end of the fixed terminal 70 at +y side to be bent from the plate 71 and to horizontally extend in +x direction. The connection portion 72 may be formed into a shape preferable to be connected to a power supply line of the target device. An opening 72*a* is formed at the connection portion 72 so that the fixed terminal 70 can be connected to the target device by a bolt.

A groove 74 is formed at the plate 71 over the entire perimeter around y-axis. Further, two holes 71*a* and 71*b* are formed at the plate 71 near an end at −y side that are aligned in Z direction.

As illustrated in FIG. 4 and FIG. 5, a groove 15*a* whose width is slightly narrower than the thickness of the plate 61 is formed at the inner wall 15, and the movable terminal 60 is press fitted in the groove 15*a*. An end portion of the plate 61 at −y side extends to an end portion of the extended portion 12.

Similarly, a groove 15*b* is formed at the inner wall 15. The fixed terminal 70 is press fitted in the groove 15*b*. An end of the fixed terminal 70 at −y direction extends only near a center of the base 10. An inner wall 16 extending along the fixed terminal 70 is formed in the base 10. A groove 16*a* extending in z direction is formed at the inner wall 16, and the end portion of the fixed terminal 70 is press fitted in the groove 16*a*.

As illustrated in FIG. 4 and FIG. 5, the grooves 65 and 74 are positioned near the inner wall 15, in which the plates 61 and 71 are press fitted, at +y side when the movable terminal 60 and the fixed terminal 70 are fitted in the base 10. In other words, the grooves 65 and 74 are accommodated in the extended portion 13. The grooves 65 and 74 are formed not only at main surfaces of the plates 61 and 71, but also formed at surfaces in the thickness direction that connect the main surfaces, respectively. An adhesive for sealing is coated in the grooves 65 and 74 when attaching the terminals 60 and 70 to the base 10. As the grooves 65 and 74 are formed over the entire perimeters of the plates 61 and 71 around y-axis, sealing properties of the relay 1 can be improved by coating the adhesive in the grooves 65 and 74.

Referring back to FIG. 2, holes 63*a* and 63*b* corresponding to the holes 61*a* and 61*b* are formed near one end of the braided wire 63, and holes 63*c* and 63*d* are formed near the other end of the braided wire 63. The holes 63*c* and 63*d* are formed to be aligned in the vertical direction. Similarly, holes 64*a* and 64*b* corresponding to the holes 63*a* and 63*b* are formed near one end of the movable spring 64, and holes 64*c* and 64*d* are formed near the other end of the movable spring 64.

The braided wire 63 and the movable spring 64 are provided at a main surface side of the plate 61. The braided wire 63 and the movable spring 64 are attached to the movable terminal 60 by two rivets 67*a* and 67*b* that penetrate the holes 64*a* and 64*b*, 63*a* and 63*b*, and 61*a* and 61*b*, respectively. Here, the movable spring 64 may be configured to be pressed in −x direction.

The braided wire 63 and the movable spring 64 are connected at end portions at +y side by caulking rivet type movable contacts 69*a* and 69*b* penetrating the holes 64*c* and 64*d* and 63*c* and 63*d*, respectively.

The movable contacts 69*a* and 69*b* are provided at positions facing the end portion of the plate 71 at −y side. The rivet type fixed contacts 73*a* and 73*b* penetrating the holes 71*a* and 71*b* are attached to the fixed terminal 70 at positions facing the movable contacts 69*a* and 69, respectively. As will be described later, the movable contacts 69*a* and 69*b* and the fixed contacts 73*a* and 73*b* are switched between a state in which they contact with each other (closed state) and a state in which they are separated from each other (opened state) and function as a contact that switches to electrically connect and disconnect the movable terminal 60 and the fixed terminal 70.

The backstop 66 is provided at a surface of the plate 61 to which the movable spring 64 and the braided wire 63 are connected, between the movable terminal 60 and the movable contacts 69*a* and 69*b*. As illustrated in FIG. 2, the backstop 66 is a planar plate that is stepwisely bent, and a width in z direction is substantially the same as those of the braided wire 63 and the movable spring 64.

A fixed end 66*a* of the backstop 66 is attached to the movable terminal 60, and the other end of the backstop 66 is a free end 66*b*. The backstop 66 is configured to receive caulked portions of the movable contacts 69*a* and 69*b* when the movable contacts 69*a* and 69*b* are separated from the fixed contacts 73*a* and 73*b* at the free end 66*b*, respectively, and prevent further movement of the movable spring 64 toward the movable terminal 60 to suppress oscillation of the movable spring 64. With this, the movable contacts 69*a* and 69*b* are prevented from moving back toward the fixed contacts 73*a* and 73*b* to contact the fixed contacts 73*a* and 73*b* again, respectively, due to the oscillation of the movable spring 64.

Referring back to FIG. 2, the base 10 is covered by the plate-shaped cover 120 made of a resin mold. The cover 120 has a substantially L-shape to cover the center portion 11 and the extended portion 12. Protrusions 121 and 122 are formed at the extended portion 13 side of the cover 120 at positions corresponding to the grooves 15*a* and 15*b* to press upper edges of the plates 61 and 71, respectively.

As illustrated in FIG. 2, FIG. 4 and FIG. 5, the electromagnet 30 in which a bobbin 20 made of a resin mold, and a magnetic core 40 and a yoke 50 made of iron are combined is press fitted at +x side of the accommodating portion 17 with respect to the fixed terminal 70.

As illustrated in FIG. 2, the bobbin 20 includes a barrel 21, flanges 22 and 23 formed at both ends of the barrel 21 in x direction and a through-hole 24 that penetrates the barrel 21 and the flanges 22 and 23.

As illustrated in FIG. 4 and FIG. 5, a coil 31 is wound around the barrel 21. In this embodiment, the coil 31 includes two windings, a first winding and a second winding, and the first and second windings are wound around the bobbin 20. The first winding functions as a coil that switches the contact from the opened state to the closed state, and the second winding functions as a coil that switches the contact from the closed state to the opened state. In FIG. 2, the coil 31 is not illustrated. Each of the flanges 22 and 23 has a rectangular shape, and a lower surface of each of the flanges 22 and 23 contacts a bottom surface of the base 10 so that the bobbin 20 is attached to the base 10 while taking a predetermined posture.

The magnetic core 40 includes a rod 41 and a plate 42. The rod 41 is inserted in the through-hole 24. The through-hole 24 and the rod 41 have rectangular cross-sectional shapes, corresponding to each other, and the magnetic core 40 is configured to take a predetermined posture with respect to the bobbin 20 when the rod 41 is inserted in the through-hole 24.

The plate 42 that extends to be in parallel to the flange 22 is provided at an end of the rod 41 at a flange 22 side. The plate 42 is formed to extend over the flange 22 in −y direction.

The yoke 50 includes a base plate 51 that extends in parallel to the flange 23, an intermediate plate 52 and a front plate 53. A hole 54 in which a front end of the rod 41 fits, is formed at the base plate 51. The hole 54 and the front end of the rod 41 have rectangular cross-sectional shapes corresponding to each other. Then, when the rod 41 is inserted in the hole 54, the yoke 50 is retained to take a predetermined posture with respect to the magnetic core 40.

The intermediate plate 52 is formed at −y side of the base plate 51 that is extended over the flange 23 by being bent from the base plate 51 in −x direction. The intermediate plate 52 is formed to extend in parallel to the rod 41. The front plate 53 is formed by being bent from the intermediate plate 52 in −y direction. The front plate 53 is formed to extend in parallel to the flanges 22 and 23.

The front plate 53 faces the end portion of the plate 42. Thus, it is configured that, when magnetic field is generated by the coil 31, magnetic flux is transmitted via the magnetic core 40 and the yoke 50 to generate magnetic field between the plate 42 and the front plate 53.

The four coil terminals 35*a*, 35*b*, 35*c* and 35*d* are connected to the coil 31. Specifically, the coil terminals 35*a* and 35*c* are connected to the first winding, and the coil terminals 35*b* and 35*d* are connected to the second winding. The coil 31 is connected to the coil terminals 35*a*, 35*b*, 35*c* and 35*d* such that when current flows through one of the pairs (35*a*, 35*c*), magnetic field is generated in +x direction, and when current flows through the other of the pairs (35*b*, 35*d*), magnetic field is generated in −x direction. This will be described later in detail with reference to FIG. 6 to FIG. 12.

A holder 25 to which the coil terminals 35*a*, 35*b*, 35*c* and 35*d* are attached is integrally formed with the bobbin 20. The holder 25 is protruded from an upper edge of the flange 23 in +x direction, and base ends of the coil terminals 35*a*, 35*b*, 35*c* and 35*d* are inserted at an end surface at +x side, respectively. Front ends of the coil terminals 35*a*, 35*b*, 35*c* and 35*d* are extended to be bent in −z direction, and protrude toward outside of the base 10 through an opening formed at a bottom surface of the base 10.

As illustrated in FIG. 2, FIG. 4 and FIG. 5, the actuator 80 is operated by a magnetic force generated by the electromagnet 30, and switches the movable terminal 60 and the fixed terminal 70 between an electrically connected state and an electrically disconnected state. The actuator 80 is made of a resin mold, has an L planar shape, and includes a shaft 81 that extends in z direction at an end of the L shape. As the shaft 81 is rotatably attached to the base 10, the actuator 80 is revolvable around the shaft 81 as a center. The actuator 80 is also accommodated in the accommodating portion 17 of the base 10.

Holes 83 and 84 are formed at an end 82 of the actuator 80 that is opposite from the shaft 81. The pair of armatures 91 and 92 are fitted in the holes 83 and 84, respectively. The armatures 91 and 92 are plates made of iron. The armatures 91 and 92 are provided to extend in parallel with each other by being fitted in the holes 83 and 84, respectively. The armatures 91 and 92 include protrusions 91*a* and 92*a* and enlarged portions 91*b* and 92*b*, respectively. The protrusions 91*a* and 92*a* are inserted from a surface of the end 82 at a shaft 81 side and protruded from an opposite surface of the end 82, respectively. The enlarged portions 91*b* and 92*b* are formed at end portions of the armatures 91 and 92 that are opposite from the protrusions 91*a* and 92*a*, respectively, and protruded at both sides in z direction. The protruded portions of the enlarged portions 91*b* and 92*b* are fitted in enlarged portions (not illustrated) of the holes 83 and 84 to fix the armatures 91 and 92 to the actuator 80, respectively.

The permanent magnet 93 is sandwiched between the enlarged portions 91*b* and 92*b*, respectively, and is retained by being fitted in a groove formed at the surface of the end 82 at the shaft 81 side. The armatures 91 and 92 are connected to poles of the permanent magnet 93 so that constant magnetic field is always generated between the protrusions 91*a* and 92*a* of the armatures 91 and 92, respectively.

The armature 92 is provided such that the protrusion 92*a* is positioned between the plate 42 and the front plate 53. The armature 91 is provided such that the protrusion 91*a* is positioned at an opposite side of the plate 42 with respect to the front plate 53. In other words, the front plate 53 is positioned between the armature 91 and the armature 92.

Force is applied to the armatures 91 and 92 by interaction of magnetic field generated between the protrusions 91*a* by the permanent magnet 93, and magnetic field generated between the plate 42 and the front plate 53 by the coil 31. With this, the force is applied to the actuator 80 via the armatures 91 and 92, and the actuator 80 is rotated. By changing flowing direction of current in the coil 31, a direction of magnetic field can be changed. Further, with this, a direction of a force applied to the armatures 91 and 92 can be either of +x direction and −x direction. This operation is described later in detail with reference to FIG. 6 to FIG. 12.

The card 100 is attached to the actuator 80 and transmits the operation of the actuator 80 to the movable contacts 69*a* and 69*b*. The card 100 is attached at a surface of the actuator 80 from which the protrusions 91*a* and 92*a* are protruded. The card 100 includes an edge 101 and two vertical pieces 102 and 103 that are aligned in x direction and extending in −z direction in parallel with each other. When attaching the card 100 to the actuator 80, the card 100 is held while the end of the movable spring 64 at −y side is sandwiched between the vertical pieces 102 and 103.

As such, as the movable spring 64 is sandwiched by the card 100, the movable spring 64 is moved in accordance with the rotation of the actuator 80. With this, the movable contacts 69*a* and 69*b* attached to the movable spring 64 are also moved in the same direction with the movable spring 64 to take a first position. As a result, when the actuator 80 takes a set position illustrated in FIG. 4, the movable contacts 69*a* and 69*b* contact the fixed contacts 73*a* and 73*b*, respectively, and the movable terminal 60 and the fixed terminal 70 are electrically connected. On the other hand, when the actuator 80 takes a reset position illustrated in FIG. 5, the movable contacts 69*a* and 69*b* are separated from the fixed contacts 73*a* and 73*b*, respectively, and the movable terminal 60 and the fixed terminal 70 are electrically disconnected.

Next, an operation of the relay 1 is described with reference to FIG. 6 to FIG. 12. The relay 1 is configured to switchable between the closed state and the opened state. First, a switching operation from the opened state to the closed state is described with reference to FIG. 6 to FIG. 8. Here, in FIG. 6 to FIG. 11, only the armatures 91 and 92 and the permanent magnet 93, among the components of the actuator 80, are illustrated.

Figure 6:
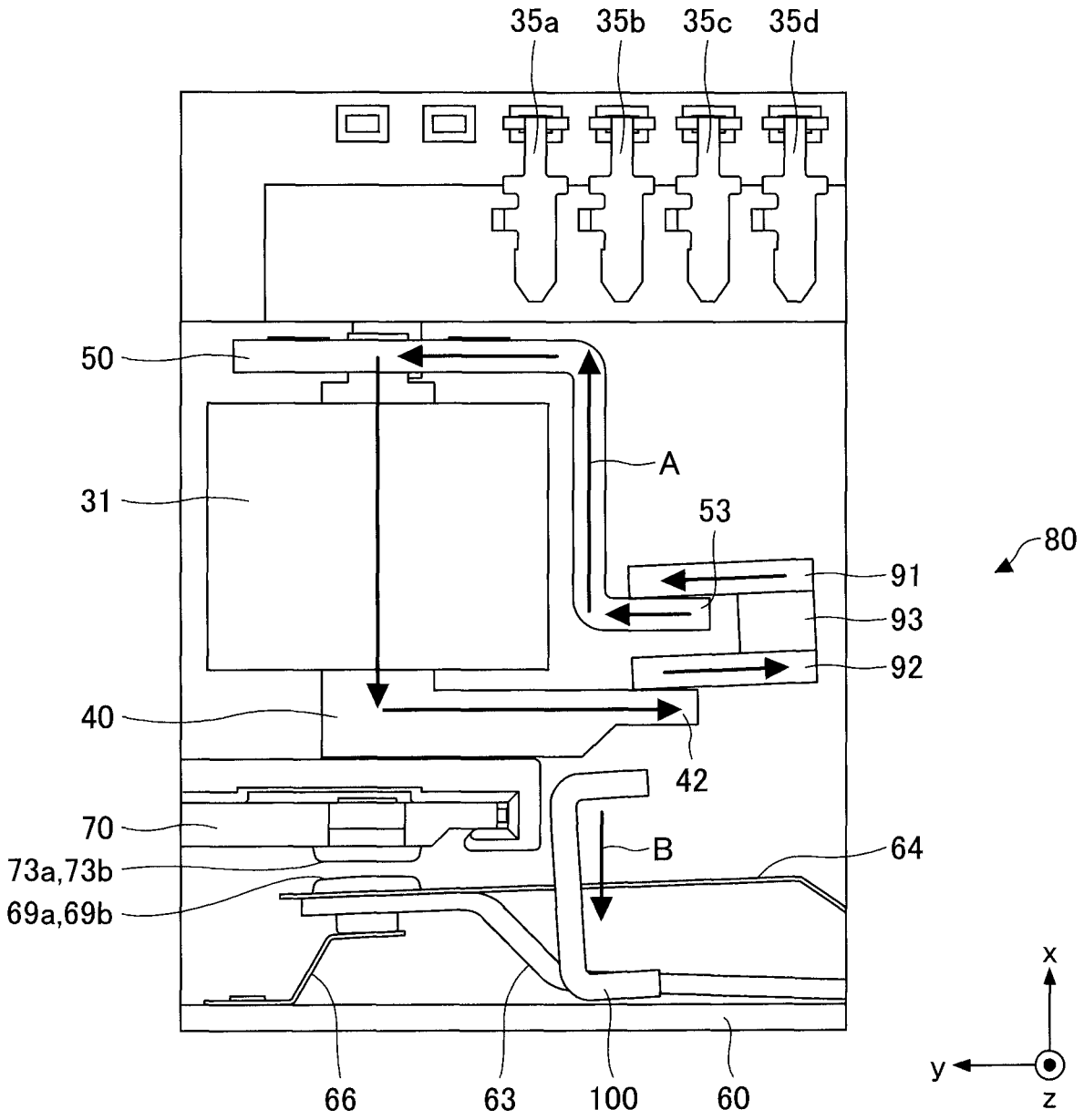
FIG. 6 is a view illustrating a switching operation from the opened state to the closed state.

As illustrated in FIG. 6, before the relay 1 is operated, the actuator 80 is set at the reset position by magnetic flux of the permanent magnet 93. At this time, the armature 91 contacts the yoke 50, and the armature 92 contacts the magnetic core 40.

At the opened state illustrated in FIG. 6, a magnetic flux loop "A" by the permanent magnet 93 is formed in order from the permanent magnet 93, the armature 91, the yoke 50, the magnetic core 40, the armature 92 and the permanent magnet 93 as illustrated by an arrow "A" in FIG. 6, and a magnetic circuit formed by the magnetic core 40, the yoke 50 and the pair of armatures 91 and 92 becomes a closed state.

The contact between the armature 91 and the yoke 50, and the contact between the armature 92 and the magnetic core 40 are retained by the magnetic flux loop "A", and the actuator 80 is retained at the reset position. Thus, the state of FIG. 6 is stably retained. When the actuator 80 is retained at the reset position, the card 100 moves the movable spring 64 as illustrated by an arrow "B" in FIG. 6. With this, the movable contacts 69*a* and 69*b* are separated from the fixed contacts 73*a* and 73*b*, respectively.

Figure 7:
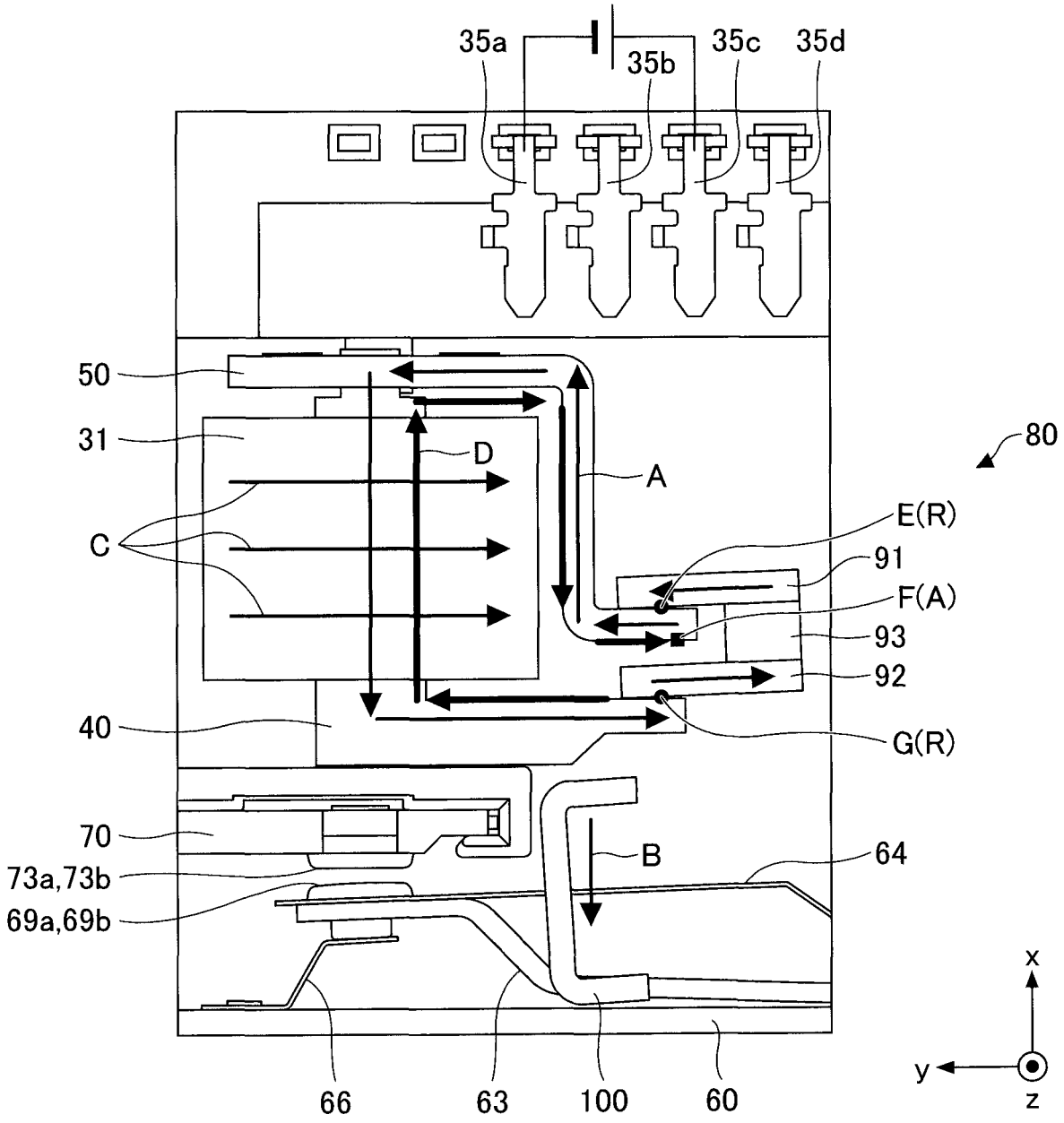
FIG. 7 is a view illustrating the switching operation from the opened state to the closed state.

Next, as illustrated in FIG. 7, voltage is applied to the coil terminals 35*a* and 35*c*. Then, current "C" flows through the first winding of the coil 31. At this time, as illustrated by an arrow "C" in FIG. 7, when seen from −x direction, the current flows in a clockwise direction through the coil 31 around the magnetic core 40.

As such, when the current "C" flows through the coil 31, as illustrated by an arrow "D" in FIG. 7, a magnetomotive force in a direction from the magnetic core 40, the yoke 50, the armature 91, the permanent magnet 93, the armature 92 and the magnetic core 40 is generated. This means that a loop "D" that is opposite direction from the magnetic flux loop "A" is generated. By the magnetomotive force loop "D", repulsive forces are generated at a contacting portion "E" of the armature 91 and the yoke 50, and a contacting portion "G" of the armature 92 and the magnetic core 40, respectively, and an attraction force is generated at an area "F" between the armature 92 and the yoke 50. Here, the attraction force is illustrated as "(A)", and the repulsive force is illustrated as "(R)" in the drawings.

Figure 8:
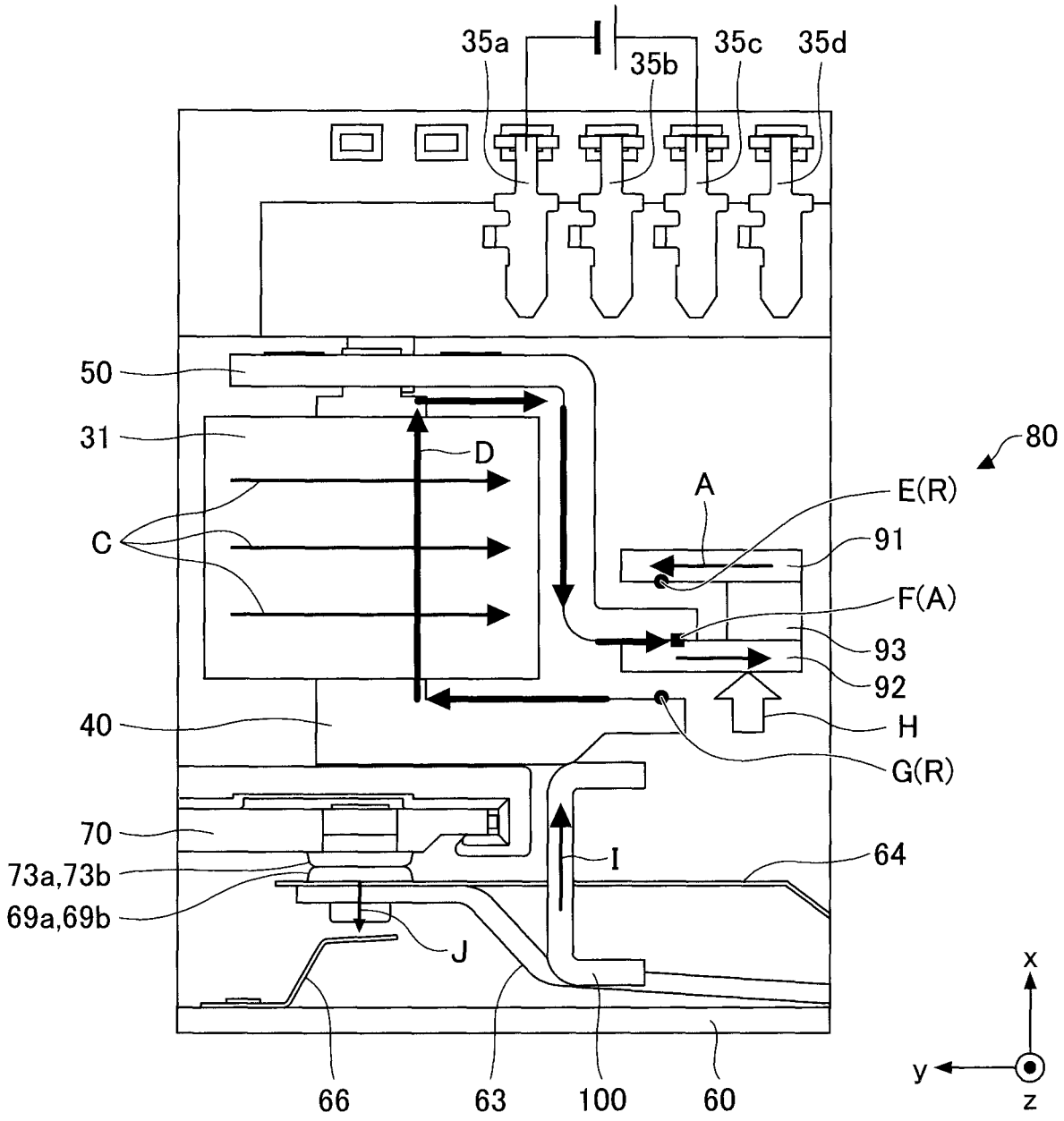
FIG. 8 is a view illustrating the switching operation from the opened state to the closed state.

Next, by the repulsive forces and the attraction force generated by the magnetomotive force loop "D", the actuator 80 is driven in a direction "H" in FIG. 8. With this, the armature 91 is moved away from the yoke 50 and the armature 92 is also moved away from the magnetic core 40 to contact the yoke 50. Thus, the actuator 80 is changed to take the set position. While the current "C" flows through the coil 31, the actuator 80 is retained at the set position illustrated in FIG. 8. Here, the armature 91 does not contact other components such as the yoke 50 under the state of FIG. 8.

By such drive of the actuator 80 from the reset position to the set position, the card 100 moves the movable spring 64 in a direction "I" in FIG. 8. With this, the movable contacts 69*a* and 69*b* caulked to the movable spring 64 also moves with the card 100 and the movable spring 64. As a result, the movable contacts 69*a* and 69*b* move close to the fixed contacts 73*a* and 73*b* and contact the fixed contacts 73*a* and 73*b*, respectively to become the closed state. At this time, as the movable spring 64 is pressed in −x direction, a returning force is generated in a direction "J". However, as the magnetomotive force by the magnetomotive force loop "D" is larger, the closed state is retained. In other words, while set voltage is applied to the coil terminals 35*a* and 35*c*, the closed state is retained.

Then, at the closed state illustrated in FIG. 8, the magnetic flux loop "A" by the permanent magnet 93 is not formed, and the magnetic circuit formed by the magnetic core 40, the yoke 50 and the pair of armatures 91 and 92 becomes an opened state.

Next, a switching operation from the closed state of FIG. 8 to the opened state is described with reference to FIG. 9 to FIG. 12.

Figure 9:
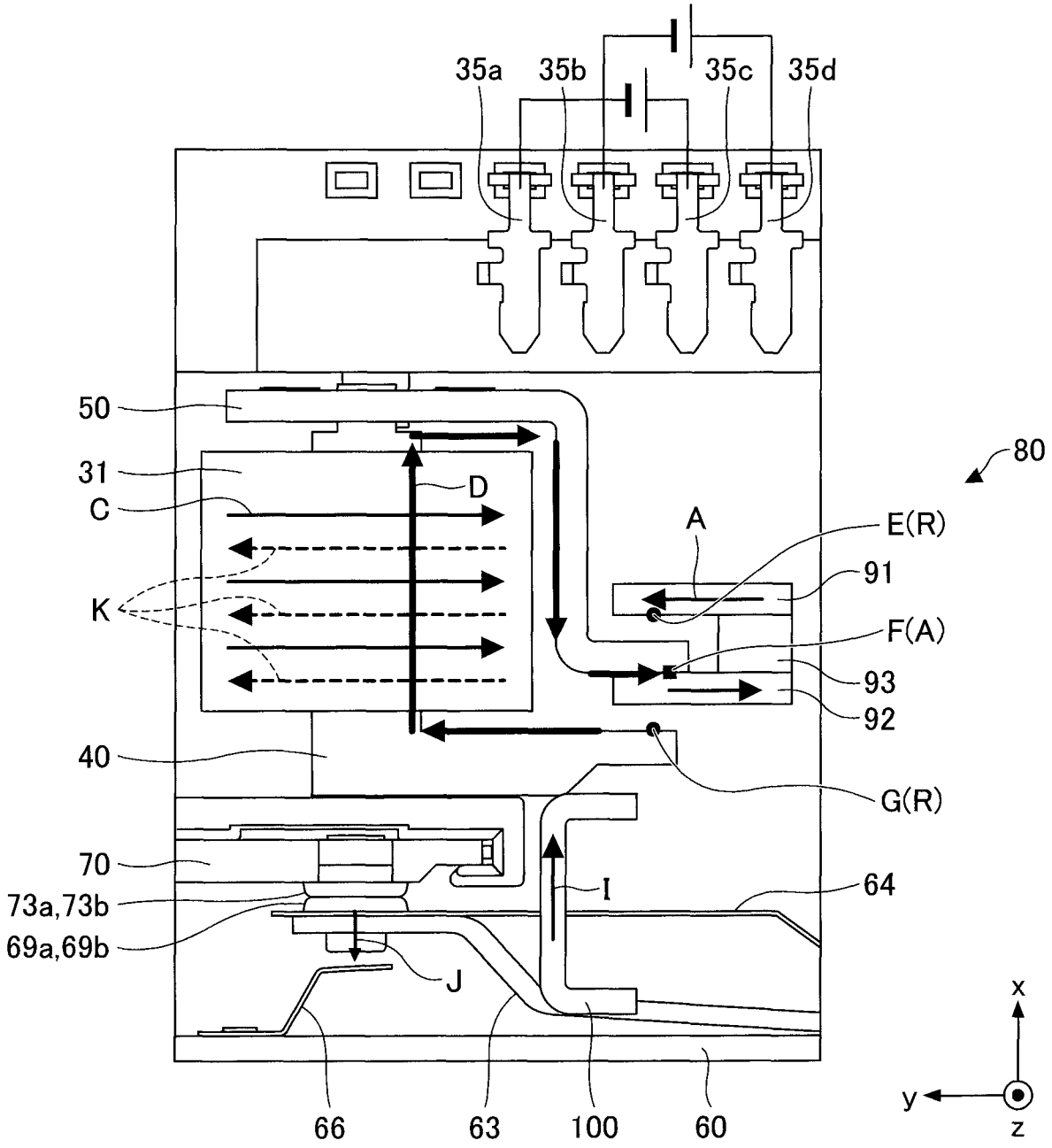
FIG. 9 is a view illustrating a switching operation from the closed state to the opened state.
Figure 10:
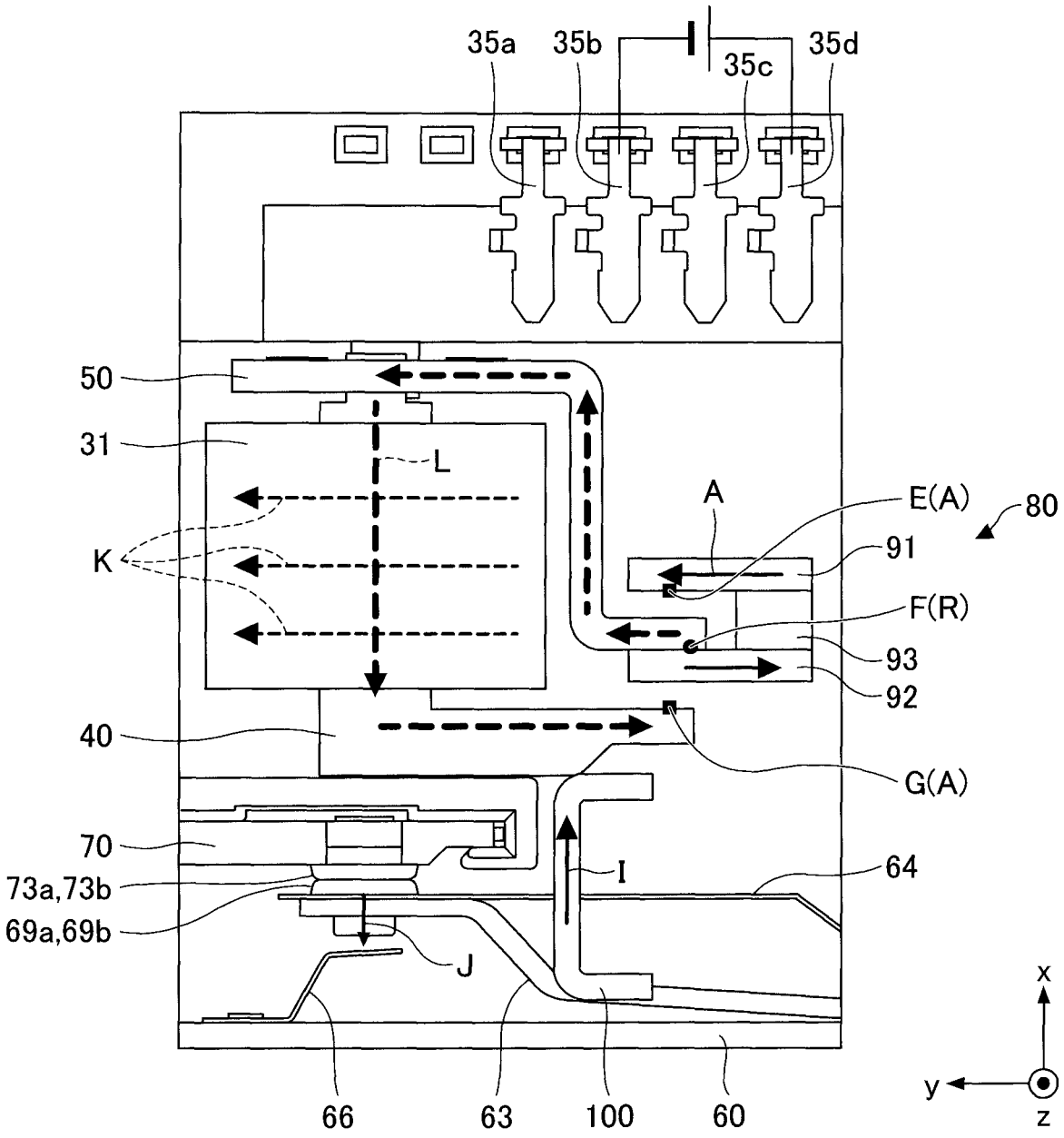
FIG. 10 is a view illustrating of the switching operation from the closed state to the opened state.

First, while the voltage is continuously applied to the coil terminals 35*a* and 35*c* as illustrated in FIG. 8, voltage is further applied to the coil terminals 35*b* and 35*d* as illustrated in FIG. 9. With this, as illustrated by an arrow "K" in FIG. 9, when seen from −x direction, current "K" flows in a counterclockwise direction through the coil 31 around the magnetic core 40. In other words, the state illustrated in FIG. 9 is an overlapping state in which both the voltage that drives the actuator 80 to the set position and voltage that drives the actuator 80 to the reset position are applied.

Figure 12:
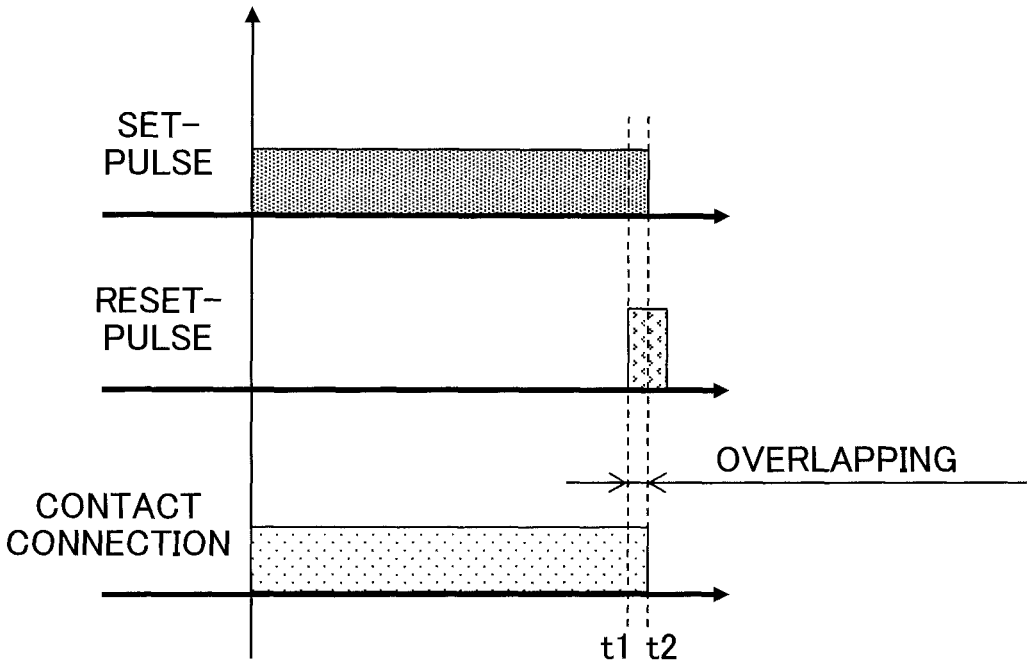
FIG. 12 is a view illustrating time courses of a set-pulse, a reset-pulse and a contact connection, respectively, when switching from the closed state to the opened state.

The overlapping state is described with reference to FIG. 12. FIG. 12 illustrates time courses of the set-pulse, the reset-pulse and contact connection, when switching from the closed state to the opened state. In FIG. 12, a period at which the graph of the contact connection is risen up is the closed state. In FIG. 12, the reset-pulse is risen up at "t1" while the set-pulse is risen up and the contacts are connected. Then, the set-pulse is terminated at "t2", and the actuator 80 is operated to disconnect the contacts by the reset-pulse. In this embodiment, when the contacts are switched from the closed state to the opened state, the overlapping state in which both the set-pulse and the reset-pulse are risen up as a period between "t1" to "t2" of FIG. 12 is provided.

At the overlapping state illustrated in FIG. 9, the actuator 80 is retained at the set position by the magnetic flux "A". Meanwhile, the magnetic force generated in the coil 31 by the current "C" and the magnetic force generated in the coil 31 by the current "K" are, although depending magnitudes of the magnetic forces, almost compensated with each other.

When the set-pulse is terminated after "t2", only the current "K" flows through the coil 31. Thus, as illustrated by an arrow "L" in FIG. 10, a magnetomotive force from the magnetic core 40, the armature 92, the permanent magnet 93, the armature 91, the yoke 50 to the magnetic core 40 is generated. In other words, a loop that is in opposite direction from the magnetomotive force loop "D" is generated.

By the magnetomotive force loop "L", attraction forces are generated at an area "E" between the armature 91 and the yoke 50 and an area "G" between the armature 92 and the magnetic core 40, and a repulsive force is generated at a contacting portion "F" of the armature 92 and the yoke 50.

Figure 11:
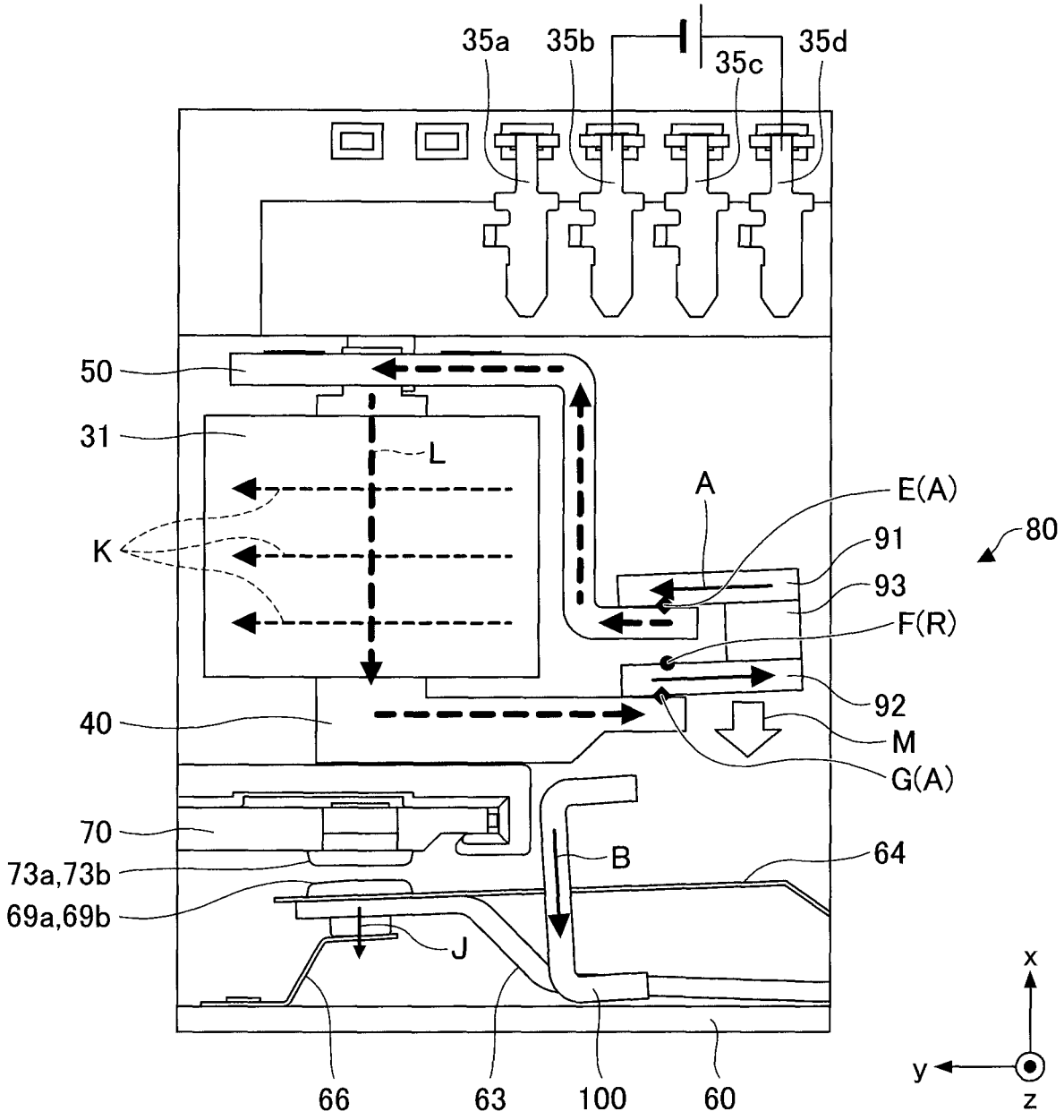
FIG. 11 is a view illustrating of the switching operation from the closed state to the opened state.

Next, as illustrated in FIG. 11, by the repulsive force and the attraction forces generated by the magnetomotive force loop "L" and the reaction force "J" of the movable spring 64, the actuator 80 is driven in a direction "M" in FIG. 11. With this, the armature 91 contacts the yoke 50, and the armature 92 moves away from the yoke 50 to contact the magnetic core 40, and the actuator 80 is switched from the set position to the reset position.

By driving the actuator 80 from the set position to the reset position, the card 100 moves the movable spring 64 in a direction "B" in FIG. 11. By the movement of the movable spring 64 in a direction "B", the movable contacts 69*a* and 69*b* caulked with the movable spring 64 also moves in the same direction, and the movable contacts 69*a* and 69*b* are moved away from the fixed contacts 73*a* and 73*b*, respectively, to become the opened state. At this time, as illustrated in FIG. 11, the movable contacts 69*a* and 69*b* driven toward −x direction are received by the backstop 66, and oscillation of the movable spring 64 and the movable contacts 69*a* and 69*b* is suppressed.

Thereafter, by terminating applying of the voltage to the coil terminals 35*b* and 35*d*, the current "K" does not flow through the coil 31. With this, the magnetomotive force loop "L" disappears and the relay 1 returns to the state of FIG. 6. At the state of FIG. 6, the actuator 80 is retained at the reset position by the magnetic flux loop "A". Thus, a state in which the movable contacts 69*a* and 69*b* are separated from the fixed contacts 73*a* and 73*b*, respectively, is retained. This means that the contacts are stably retained at the opened state by the magnetic flux "A" during a period at which no control pulses, both the set-pulse and the reset-pulse, are applied to the coil terminal 35*a* to 35*d*. With this, the relay 1 can have high resistance against external vibration and impact, and malfunction such as the contacts are intentionally switched from the opened state to the closed state by vibration, impact and the like can be prevented.

Next, effects of the relay 1 of the embodiment are described.

When the target device generates high-current, in particular, when the target device generates high-inrush current (for a case of an engine starter, approximately 1500 A), if the inrush current flows through the contacts, contacting surfaces of the contacts may be melted by the inrush current and ark heat generated by the inrush current to cause the movable contacts 69*a* and 69*b* and the fixed contacts 73*a* and 73*b* to be welded, respectively. Similarly, such welding may occur due to chattering by an incomplete operation caused by lowering of power supply voltage, or continuous electrical arcs by frequent open and close operations by vibration caused by lowering of voltage of the coil 31.

When the contacts are welded, the movable contacts 69*a* and 69*b* cannot be separated from the fixed contacts 73*a* and 73*b* by a pressing force of the movable spring 64 if the welded force is greater than the pressing force of the movable spring 64. In such a case, a failure in returning to the opened state occurs, and a lifespan of the relay may be shortened and reliability of the relay may be lowered.

On the other hand, according to the relay 1 of the embodiment, even when the contacts are switched from the opened state to the closed state, in addition to a case when the contacts are switched from the opened state to the closed state, voltage is applied to the coil 31 to generate the magnetomotive force "L" that drives the actuator 80 in a direction to apply a force to the movable contacts 69*a* and 69*b*, and the returning force is increased. In particular, by setting the overlapping period, as the reset-pulse is applied while the set-pulse is applied, the actuator 80 can be operated by rapid and a strong force by the applied reset-pulse when the set-pulse is terminated. With this, even when the contacts are welded, a returning force that is sufficiently larger than the welded force is generated, and the movable contacts 69*a* and 69*b* can be separated from the fixed contacts 73*a* and 73*b*. As a result, the failure in returning to the opened state can be reduced, and a lifespan of the device can be increased, and operation reliability can be improved.

Further, according to the relay 1, the opened state is retained by the magnetic circuit by the permanent magnet 93. Thus, when voltage is not applied to the electromagnet 30, the opened state is surely retained, and the opened state is stabled. According to the relay 1, the magnetic flux loop "A" functions as a self-holding circuit for retaining the opened state.

According to the relay 1 of the embodiment, even used for the target device that generates high-current, which may cause the contacts to be welded, open and close operations of the contacts can be stably performed with long lifespan. Further, as the opened state can be stably retained, a risk of malfunction or failure can be reduced, and as a result, reliability can be increased.

Further, the relay 1 includes the backstop 66 that receives the movable contacts 69*a* and 69*b* moving in a direction away from the fixed contacts 73*a* and 73*b* between the movable terminal 60 and the movable spring 64.

With this configuration, the movable contacts 69*a* and 69*b* separated from the fixed contacts 73*a* and 73*b* when switching the contacts to the opened state can be prevented from being oscillated toward the fixed contacts 73*a* and 73*b* to contact the fixed contacts 73*a* and 73*b* again by the oscillation of the movable spring 64. Thus, reliability of open and close operations can be improved. However, if the backstop 66 is fitted in a resin member such as a base block of the housing or the bobbin 20, the backstop may not be accurately attached at a certain position. On the other hand, in this embodiment, as the backstop 66 is caulked with the movable terminal 60 made of a metal, accuracy of position can be increased. Further, as the backstop 66 can be provided at a space between the movable terminal 60 and the movable spring 64, it is unnecessary to provide an additional space in the relay 1 for providing the backstop 66.

Further, in the relay 1, the grooves 65 and 74 are formed at the plates 61 and 71 over the entire perimeter near an interface of the accommodating portion 17.

As the plates 61 and 71 are manufactured by press molding, the grooves 65 and 74 are formed over the entire perimeter including the cutaway surfaces of the plates 61 and 71, respectively. If the groove is not formed at the cutaway surface, adhesion strength becomes locally weak, and the adhesive may be peeled or the sealing properties may be damaged. However, by providing the groove over the entire perimeter of the plate, adhesion strength of the adhesive at the cutaway surface is increased and the sealing properties can be improved.

Figure 13A:
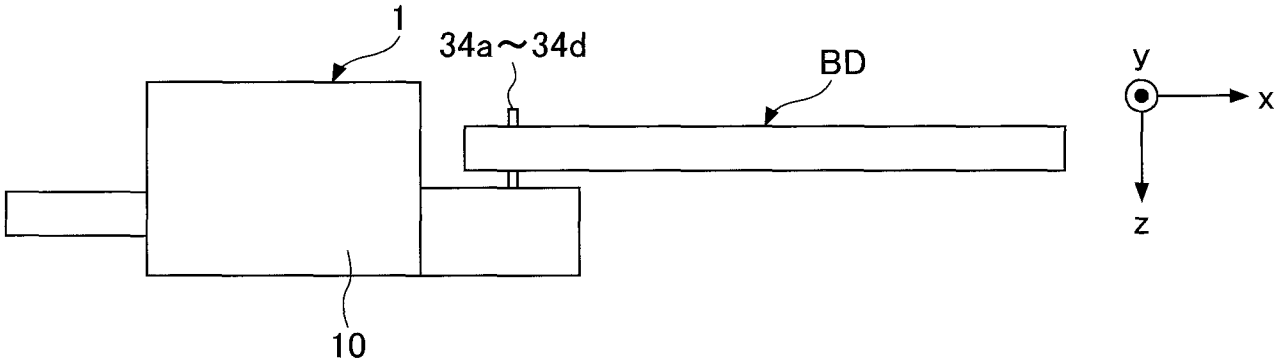
FIG. 13A and FIG. 13B are schematic views illustrating a connection between an electromagnetic relay and a substrate.

FIG. 13A is a schematic view illustrating the relay 1 connected to a substrate BD. As illustrated in FIG. 13A, the coil terminals 35*a*, 35*b*, 35*c* and 35*d* are mounted on the base 10 so as to expose from the base 10. Thus, the coil terminals 35*a*, 35*b*, 35*c* and 35*d* can be directly mounted on the substrate BD by soldering, for example.

Figure 13B:
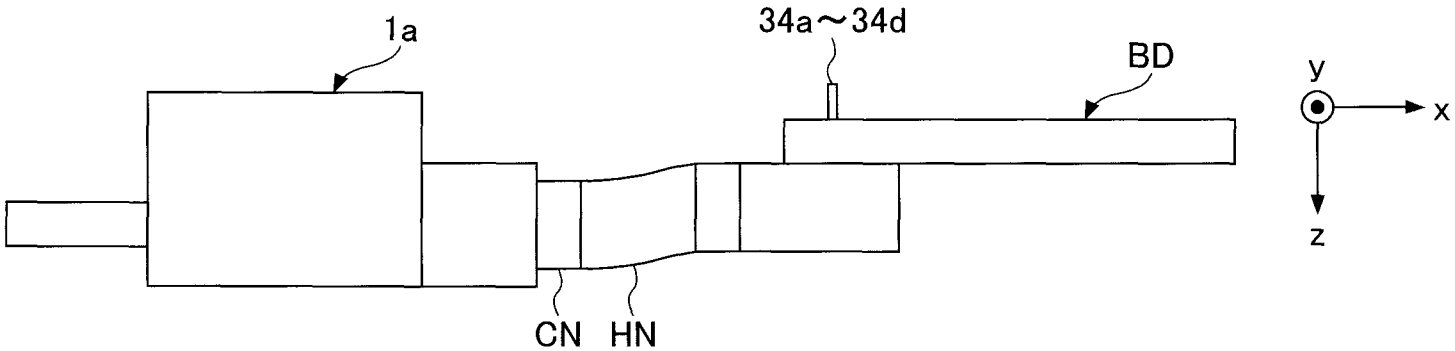

FIG. 13B illustrates a comparative relay 1*a* connected to the substrate BD via a connector CN and a harness HN. According to the relay 1 of the embodiment compared with the relay 1*a*, the number of steps for the connection can be reduced, the connecting operation can be simplified, and space can be saved.

By forming each of the coil terminals 35*a*, 35*b*, 35*c* and 35*d* to have a press-fit shape in which the shape of the terminal is expanded in a direction perpendicular to an inserting direction to have a spring property, the coil terminals 35*a*, 35*b*, 35*c* and 35*d* can be more easily attached to the substrate BD. By press fitting the terminal in the through hole, electrical connection and mechanical holding can be provided at the same time, and it is unnecessary to connect the terminal by soldering.

Modified Examples

Figure 14:
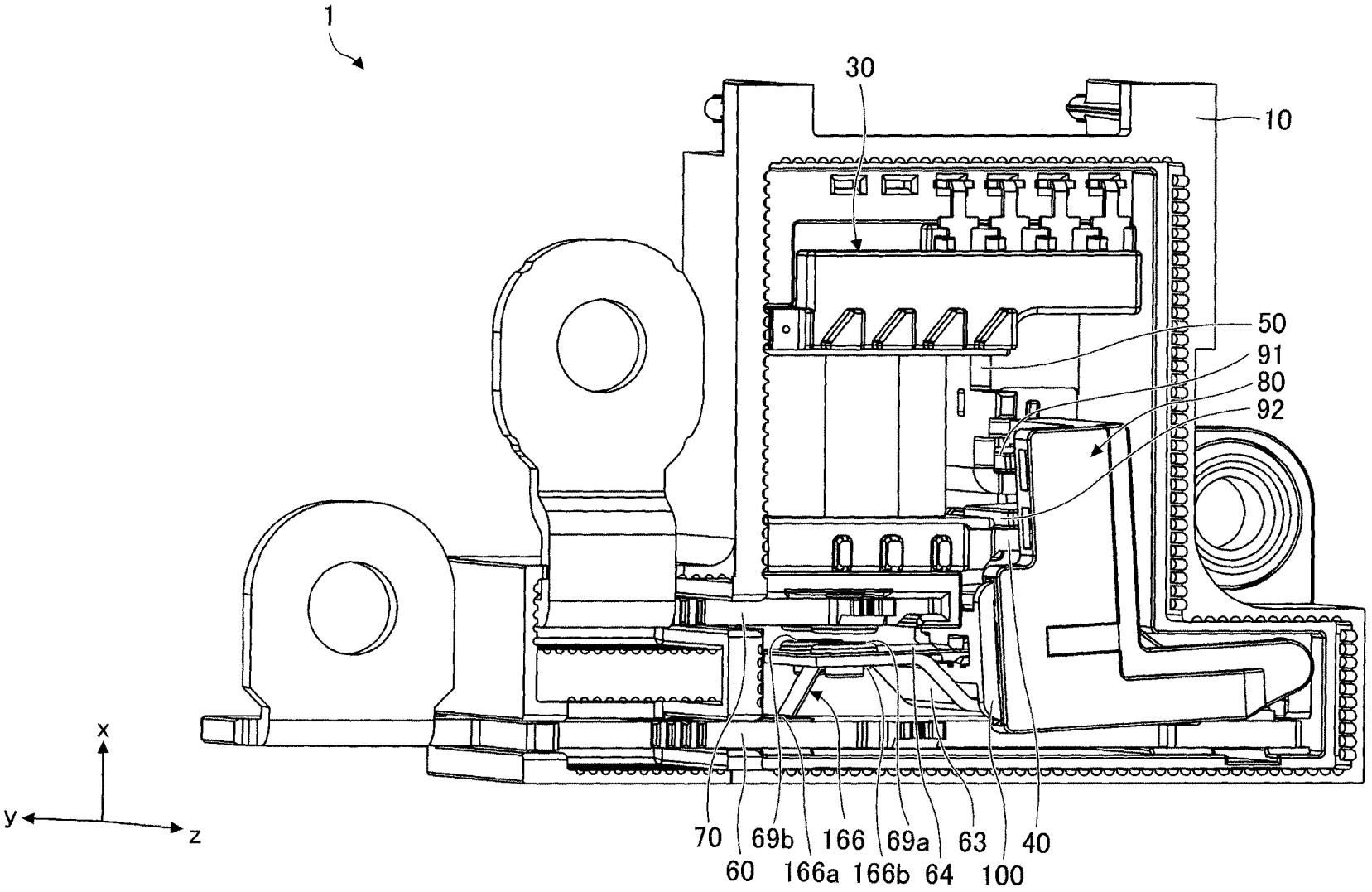
FIG. 14 is a perspective view illustrating a first modified example of a backstop.
Figure 15:
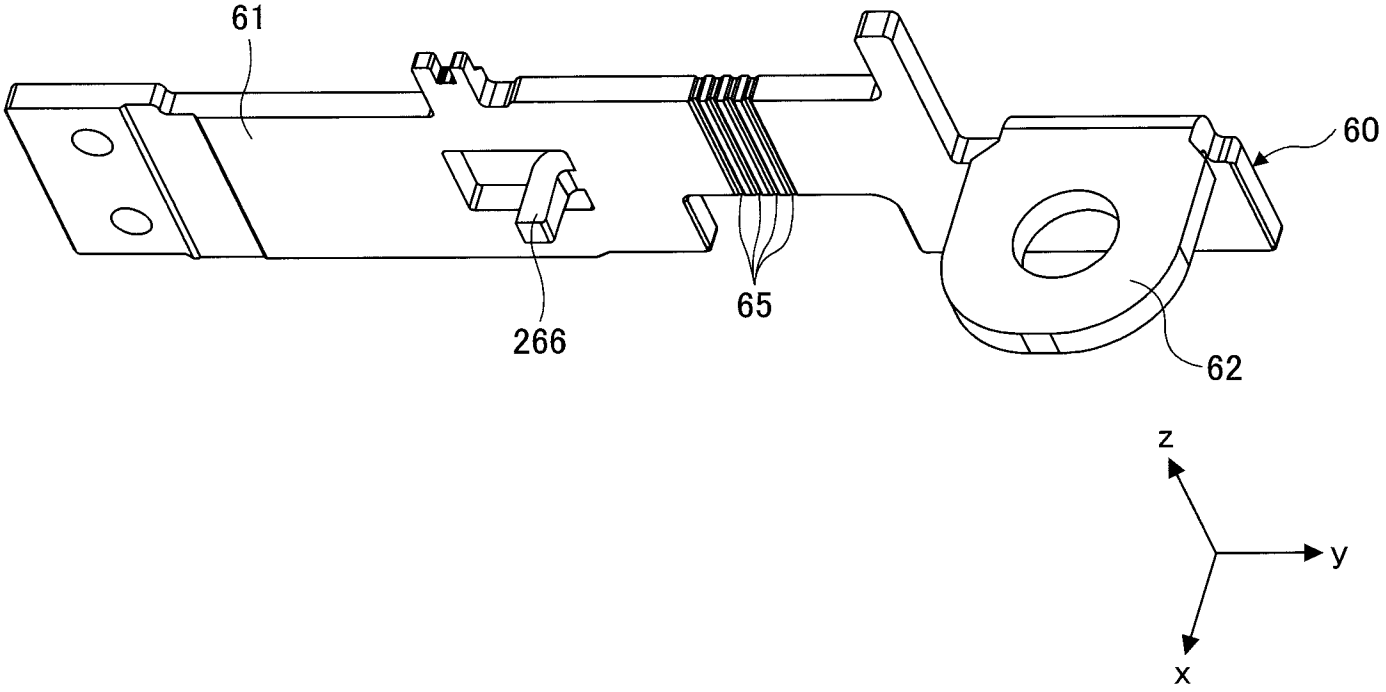
FIG. 15 is a perspective view illustrating a second modified example of the backstop.
Figure 16:
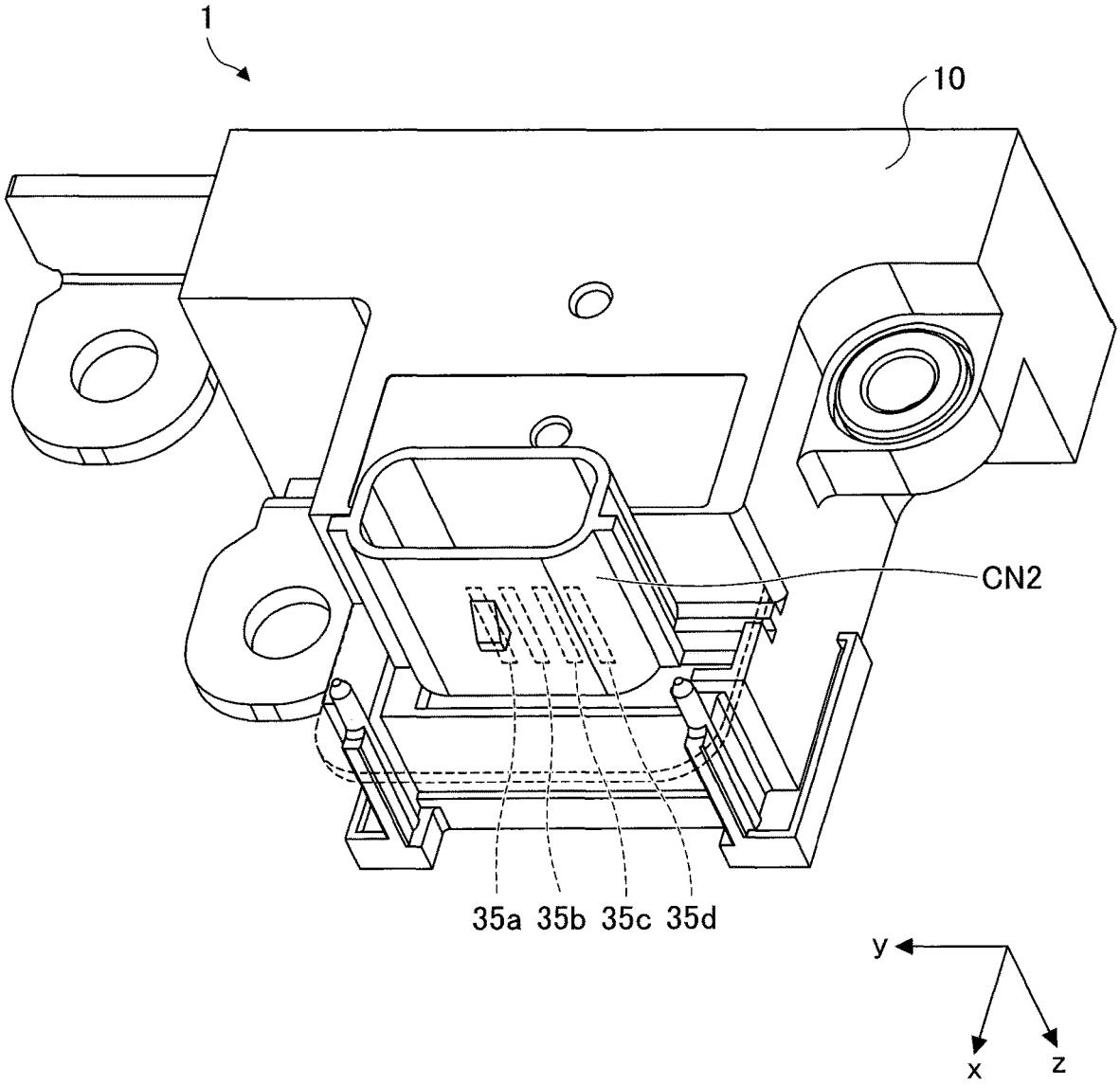
FIG. 16 is a perspective view illustrating an modified example of a coil terminal.

Modified examples of the embodiments are described with FIG. 14 to FIG. 16.

FIG. 14 is a perspective view illustrating a first modified example of the backstop.

In the above described embodiment, the free end 66*b* is formed to have substantially the same width as those of the braided wire 63 and the movable spring 64, and the backstop 66 is configured to receive the movable contacts 69*a* and 69*b* by the free end 66*b*. Alternatively, as long as the backstop 66 can receive the movable contacts 69*a* and 69*b*, the backstop 66 may have a different shape.

The width of the backstop 166 illustrated in FIG. 14 in z direction is set to be the same as a space between the movable contacts 69*a* and 69*b* so that the free end 166*b* can contact the braided wire 63 at the space between the movable contacts 69*a* and 69*b*. In such a case, when the movable contacts 69*a* and 69*b* are moved away from the fixed contacts 73*a* and 73*b* as illustrated in FIG. 14, the backstop 166 is positioned at the space between the movable contacts 69*a* and 69*b* to contact the surface of the braided wire 63 and receive the movable contacts 69*a* and 69*b*.

FIG. 15 is a perspective view illustrating a second modified example of the backstop. In this embodiment, the backstop 66 is separately formed from and attached to the movable terminal 60. Alternatively, as illustrated in FIG. 15, a backstop 266 may be integrally formed with the movable terminal 60. In such a case, as illustrated in FIG. 15, the backstop 266 may be formed by cutting a part of the plate 61 and bending the cut part to protrude in +x direction. By integrally forming the backstop 266 with the movable terminal 60, the number of parts can be reduced, manufacturing cost can be reduced and fabrication ease can be improved.

FIG. 16 is a perspective view illustrating a modified example of coil terminals. In the above embodiment, the coil terminals 35*a*, 35*b*, 35*c* and 35*d* are exposed from the base 10 and are attached directly to the substrate BD. Alternatively, as illustrated in FIG. 16, a portion of the base 10 near a position at which the coil terminals 35*a*, 35*b*, 35*c* and 35*d* are exposed may be formed to have a connector shape. Then, the coil terminals 35*a*, 35*b*, 35*c* and 35*d* may be used as contacts of a connector CN2 in FIG. 16. With this configuration, even when the relay is to be connected to the substrate BD by a connector, the relay 1 can be connected. Thus, the relay 1 of the embodiment can be connected to various types of substrates BD.

According to embodiments, an electromagnetic relay with high reliability can be provided.

Although an embodiment of the relay has been specifically illustrated and described, it is to be understood that minor modifications may be made therein without departing from the spirit and scope of the invention as defined by the claims.

The present invention is not limited to the disclosed embodiments, and numerous variations and modifications may be made without departing from the spirit and scope of the present invention. The placement, material, condition, shape, size and the like of each component are not limited to the described examples, and may be appropriately modified. Further, components described in different embodiments or examples may be partially substituted by each other, or combined with each other.

In the above embodiment, currents "C" and "K" of opposite directions are flowed in the first winding and the second winding of the coil 31, respectively, for switching from the opened state to the closed state and from the closed state to the opened state. Alternatively, as long as the magnetomotive force loops "D" and "L" of opposite directions can be generated, another structure may be used. Further, although the disclosed coil 31 includes two windings, the coil may include a single winding, and current may be flowed in the winding in opposite directions to generate magnetomotive force loops of opposite directions. However, in such a case, a mechanism to protect the circuit is necessary.

What is claimed is:

1. A method for controlling an electromagnetic relay comprising a fixed contact, a movable contact that comes in contact with and separated from the fixed contact, an electromagnet that includes a coil for generating magnetic field, and an actuator that moves the movable contact by the magnetic field generated by the electromagnet, the method comprising:

when separating the movable contact that is in contact with the fixed contact, supplying a first current to the coil to generate a first magnetomotive force that drives the actuator in a direction to move the movable contact toward the fixed contact, supplying a second current to the coil, while the first current is supplied to the coil, to generate a second magnetomotive force that drives the actuator in a direction to move the movable contact away from the fixed contact, and stop supplying the first current while the second current is supplied to the coil.

2. The method for controlling the electromagnetic relay according to claim 1, wherein the first current is supplied to the coil in a first direction, and the second current is supplied to the coil in a second direction opposite to the first direction.

3. The method for controlling the electromagnetic relay according to claim 1, wherein the coil includes a first coil and a second coil, and wherein the first current is supplied to a first coil, and the second current is supplied to the second coil.

4. A method for controlling an electromagnetic relay comprising a fixed contact, a movable contact that comes in contact with and separated from the fixed contact, an electromagnet that includes a coil for generating magnetic field, and an actuator that moves the movable contact by the magnetic field generated by the electromagnet, the method comprising:

continuously supplying a first current to the coil to generate a first magnetomotive force that drives the actuator in a direction to move the movable contact toward the fixed contact during a period that the movable contact is in contact with the fixed contact;

when separating the movable contact from the fixed contact, supplying a second current to the coil, while keep supplying the first current to the coil, to generate a second magnetomotive force that drives the actuator in a direction to move the movable contact away from the fixed contact, and stop supplying the first current to the coil.

5. A method for controlling an electromagnetic relay comprising a fixed contact, a movable contact that comes in contact with and separated from the fixed contact, an electromagnet that includes a coil that generates a magnetic field when an electric current is supplied, and an actuator that moves the movable contact by the magnetic field generated by the electromagnet, the method comprising:

when separating the movable contact that is in contact with the fixed contact, generating, while a first magnetic field that drives the actuator to move the movable contact toward the fixed contact is generated by the electromagnet, a second magnetic field by the electromagnet that drives the actuator to move the movable contact away from the fixed contact, and stop generating a first magnetic field while the second magnetic field is generated.

* * * * *